US005588298A

United States Patent [19]

Kalina et al.

[11] Patent Number: 5,588,298

[45] Date of Patent: Dec. 31, 1996

[54] SUPPLYING HEAT TO AN EXTERNALLY FIRED POWER SYSTEM

[75] Inventors: Alexander I. Kalina, Hillsborough; Mark D. Mirolli, Hayward, both of Calif.

[73] Assignee: Exergy, Inc., Hayward, Calif.

[21] Appl. No.: 546,419

[22] Filed: Oct. 20, 1995

[51] Int. Cl.[6] ..... F01K 13/00

[52] U.S. Cl. ..... 60/676; 60/653; 60/679

[58] Field of Search ..... 60/676, 653, 679, 60/39.17, 39.182; 110/234, 302, 190

[56] References Cited

U.S. PATENT DOCUMENTS

| | | | |
|---|---|---|---|
| 4,346,561 | 8/1982 | Kalina | 60/673 |
| 4,354,821 | 10/1982 | Kesselring et al. | 431/7 |
| 4,489,563 | 12/1984 | Kalina | 60/673 |
| 4,548,043 | 10/1985 | Kalina | 60/673 |
| 4,586,340 | 5/1986 | Kalina | 60/673 |
| 4,604,867 | 8/1986 | Kalina | 60/653 |
| 4,732,005 | 3/1988 | Kalina | 60/673 |
| 4,763,480 | 8/1988 | Kalina | 60/649 |
| 4,867,674 | 9/1989 | Keller et al. | 431/351 |
| 4,899,545 | 2/1990 | Kalina | 60/673 |
| 4,982,568 | 1/1991 | Kalina | 60/649 |
| 5,029,444 | 7/1991 | Kalina | 60/673 |
| 5,085,156 | 2/1992 | Dykema | 110/347 |
| 5,095,708 | 3/1992 | Kalina | 60/673 |
| 5,440,882 | 8/1995 | Kalina | 60/641.2 |
| 5,450,821 | 9/1995 | Kalina | 60/676 |

*Primary Examiner*—Denise Gromada
*Assistant Examiner*—Alfred Basichas
*Attorney, Agent, or Firm*—Fish & Richardson P.C.

[57] ABSTRACT

Apparatus and method for supplying heat to an externally fired power system by using a multistage system having two or more combustion zones. Each combustion zone has an associated heat exchanger that conveys a respective working fluid stream from the externally fired power system. Each combustion zone receives a portion of the total amount of combustion fuel, and the amount of fuel and air supplied to each combustion zone is adjusted to control the temperature to a predetermined value.

22 Claims, 2 Drawing Sheets

SUPPLYING HEAT TO AN EXTERNALLY FIRED POWER SYSTEM

BACKGROUND OF THE INVENTION

The invention relates to supplying heat to an externally fired power system.

In direct fired power plants, fuel, e.g., pulverized coal, is burned in a combustion chamber in which combustion air, typically preheated, is supplied. Tubes surrounding the flame zone contain a working fluid (e.g., water) that is heated to boiling and then delivered to a power system (e.g., including a turbine) for conversion to a useful form of energy, such as electricity. Kalina U.S. Pat. No. 5,450,821 describes a multi-stage combustion system that employs separate combustion chambers and heat exchangers and controls the temperature of heat released at the various stages to match the thermal characteristics of the working fluid and to keep temperatures below temperatures at which $NO_x$ gasses form.

SUMMARY OF THE INVENTION

The invention features, in general, supplying heat to an externally fired power system by using a multistage system having two or more combustion zones. Each combustion zone has an associated heat exchanger that conveys a respective working fluid stream from the externally fired power system. Each combustion zone receives a portion of the total amount of combustion fuel, and the amounts of fuel and air supplied to each combustion zone are adjusted to control the temperature to a predetermined value. The combustion zone temperature can thus be controlled to prevent excessive tube metal temperatures, thereby avoiding damage. In addition, the cold portions of two or more independent fluid streams can be used to define the furnace boundaries, to additionally facilitate lower tube metal temperatures, and the temperatures of the various working fluid streams can be matched to the needs of the power system to promote efficiency.

In preferred embodiments the various combustion zones are located in the same furnace. The air supplied to one or more combustion zones is preheated using heat from the stack gas. The heat exchanger conduits surround the combustion zones. There also are convective zones connected to receive the flue gasses from the combustion zones and containing heat exchangers for transferring heat from the flue gasses to respective working fluid streams in heat exchanger conduits in the convective zones. Working fluid streams from the heat exchangers in the combustion zones can be connected in series with the working fluid streams in the convective zones.

Other advantages and features of the invention will be apparent from the following description of a particular embodiment thereof and from the claims.

DESCRIPTION OF PARTICULAR EMBODIMENTS

Figure 1:
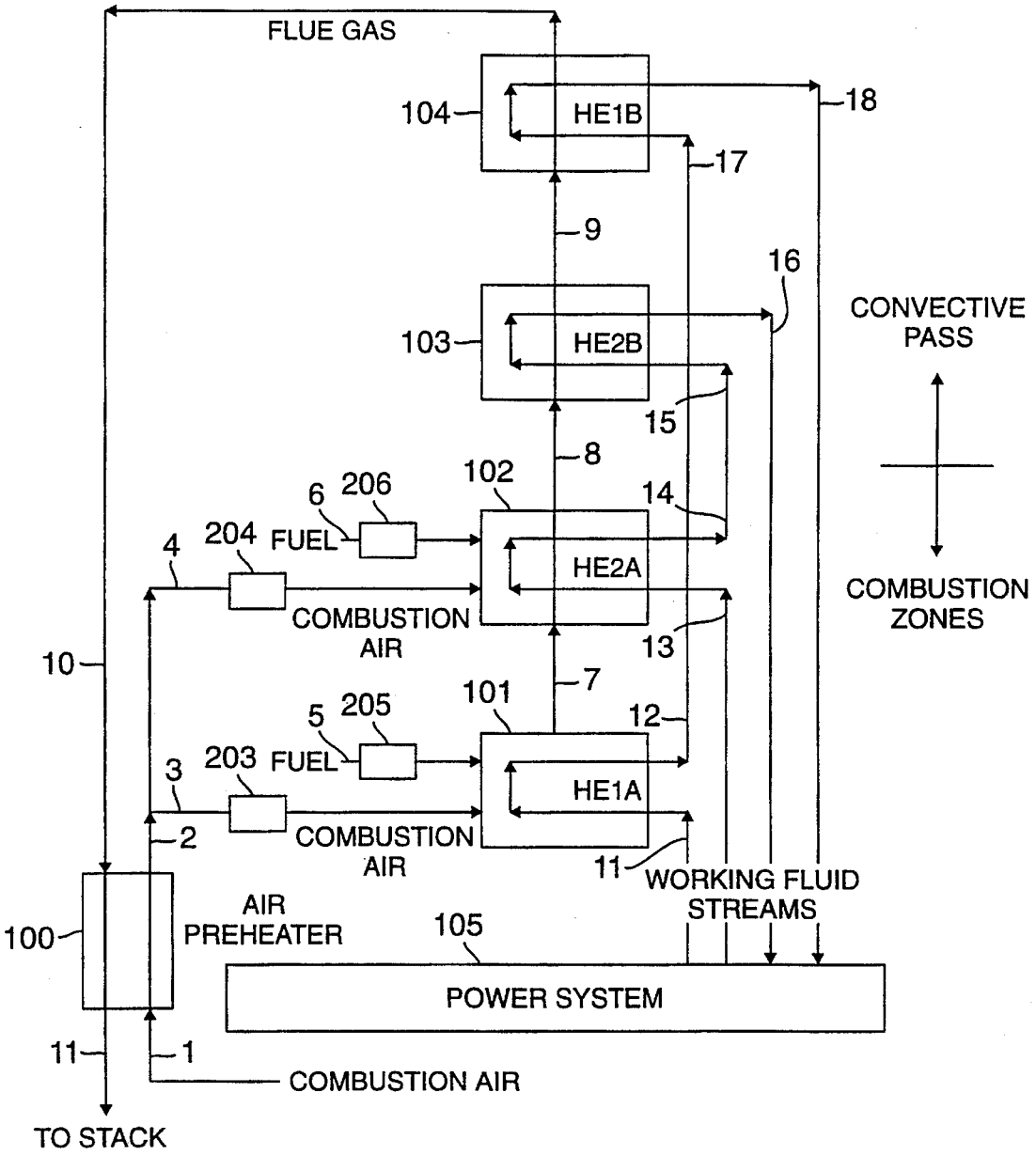
FIG. 1 is a schematic representation of an embodiment of the method and apparatus of the present invention having two combustion zones and two independent working fluid streams.
Figure 2:
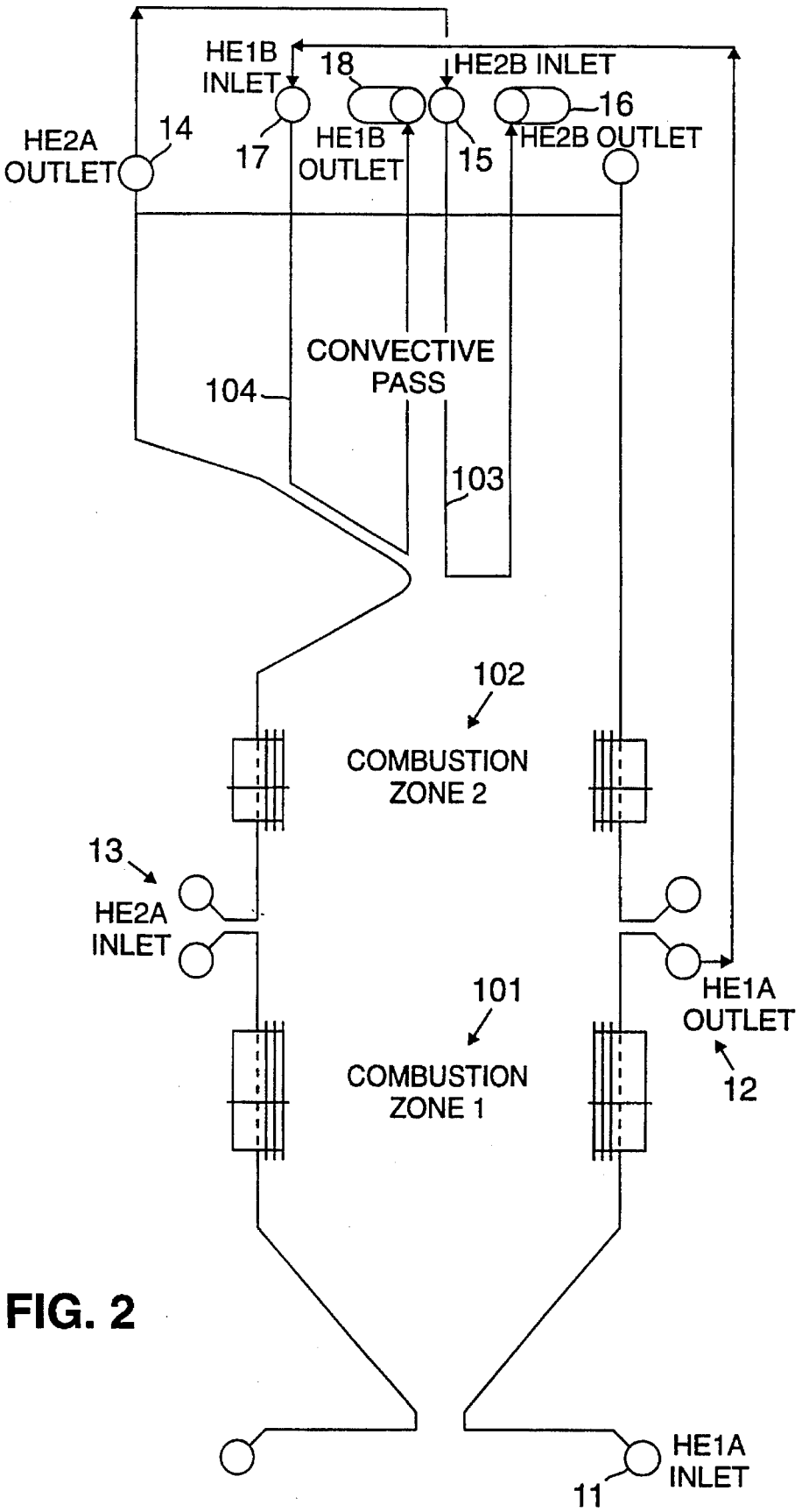
FIG. 2 is an outline drawing of the furnace and convective pass arrangement for the schematic representation shown in FIG. 1.

FIG. 1 shows a furnace system that includes an air preheater 100, two combustion zones 101 and 102, which are formed by independent working fluid cooled heat exchangers HE1A and HE2A, respectively, two convective pass zones 103 and 104, which include working fluid cooled heat exchanger HE2B and HE1B, respectively, and an external power system 105. The amounts of fuel in fuel streams 5 and 6 and the amounts of air in air streams 3 and 4 are controlled by suitable control mechanisms, shown as mechanisms 203, 204, 205, 206 on FIG. 1. Power system 105 may be any externally direct fired power conversion system. The combustion system according to the invention is particularly useful in power cycles and systems in which much of the heat needed for energy conversion cycles is used not for vaporization of working fluid, but rather for its superheating and reheating. Examples of such power systems are described, e.g., in U.S. Pat. Nos. 4,732,005 and 4,889,545, which are hereby incorporated by reference. U.S. Pat. Nos. 3,346,561; 4,489,563; 5,548,043; 4,586,340; 4,604,867; 4,732,005; 4,763,480; 4,899,545; 4,982,568; 5,029,444; 5,095,708; 5,450,821; and 5,440,882 are also incorporated by reference for disclosure of energy conversion systems. The working fluid streams may be sub-cooled liquid, saturated liquid, two-phase liquid, saturated vapor, or superheated vapor.

Referring to FIG. 1, combustion air at point 1 is fed to air preheater 100 where it is preheated to a temperature of 500°–600° F. at point 2. The amount of fuel in fuel stream 5 supplied to combustion zone 101 represents only a portion of the total fuel to be combusted. Combustion zone 101 is formed within working fluid cooled tubes of heat exchanger HE1A. A first working fluid stream enters the heat exchanger at point 11 and exits the heat exchanger with increased temperature at point 12. The heat from the flue gas stream is transferred primarily as radiant energy. The amount of fuel and pre-heated air supplied to the combustion chamber is chosen to control the combustion zone temperature to a predetermined value based upon the heat absorption requirements of the surrounding furnace walls. In particular, the combustion zone temperature in first combustion zone 101 is controlled to prevent excessive furnace wall temperatures in heat exchanger HE1A to avoid damage to the heat exchanger.

Flue gas from first combustion zone 101 passes at point 7 into the second combustion zone 102. The flue gas is mixed with a combustion air stream 4 and a fuel stream 6. The combustion zone temperature in combustion zone 102 is controlled to prevent excessive furnace wall temperatures in heat exchanger HE2A to avoid damage to the heat exchanger. Combustion zone 102 is formed within working fluid cooled tubes of heat exchanger HE2A. A second working fluid stream enters the heat exchanger HE2A at point 13 and exits with the heat exchanger with increased temperature at point 14.

Flue gas from the second combustion zone 102 passes to the convective pass of the furnace entering first convective zone 103, in which the flue gas is cooled in heat exchanger HE2B. A third working fluid stream, in this case connected in series with the second working fluid stream, enters heat exchanger HE2B at point 15 and exits heat exchanger HE2B with increased temperature at point 16 and is then returned to power system 105. Flue gas leaves convective zone 103 with lowered temperature at point 9 as compared to point 8 and passes to second convective zone 104.

Similarly, the flue gas is further cooled in second convective zone 104 by giving up heat to heat exchanger HE1B. A fourth working fluid stream, in this case connected in series with the first working fluid stream, enters heat exchanger HE1B at point 17 and exits heat exchanger HE1B with increased temperature at point 18 and is then returned to power system 105. Flue gas at point 10 exits the convective pass and flows to the air preheater 100. In the air preheater 100 the flue gas is cooled further, giving up heat to the combustion air stream, and passes to the stack with decreased temperature at point 11.

A significant advantage of the multi-stage furnace design is that the combustion temperatures reached in the individual firing zones may be controlled individually through management of the fuel and air streams. Either sub-stoichiometric or super-stoichiometric combustion may be utilized to control the firing zone temperature in the first stage. Additionally, by utilizing independent working fluid streams to form the furnace enclosure, the utilization of cold working fluid in the hottest zones of the furnace is possible. Final heating of the working fluid streams occurs in the convective pass of the furnace. The invention supplies heat to a direct fired furnace system in a way that facilitates the control of combustion zone temperatures so as to prevent excessive tube metal temperatures.

We have described a two-stage system with the combustion zones and the convective pass cooled by two independent streams of working fluid which are connected in series between the combustion zone and the convective pass. In each case a flue gas stream includes the flue gas streams from all preceding steps. Other variants may include three and four stage systems of a similar nature. In addition, independent working fluid streams may be utilized to cool only sections in the furnace or sections in the convective pass.

What is claimed is:

1. A method for supplying heat to an externally fired power system that includes the steps of:

supplying a first stream of air and a first portion of total amount of combustion fuel to a first combustion zone, combusting said first portion of fuel in said first combustion zone to form a first flue gas stream, transferring heat from said first combustion zone to a first working fluid stream from said externally fired power system in first heat exchanger conduits located within said first combustion zone, an amount of fuel and air supplied to the first combustion zone being adjusted to control the first combustion zone temperature to a first predetermined value, supplying said first flue gas stream, a second stream of air, and a second portion of the total amount of combustion fuel to a second combustion zone, combusting said second portion of fuel in said second combustion zone to form a second flue gas stream, and transferring heat from said second combustion zone to a second working fluid stream from said externally fired power system in second heat exchanger conduits exposed located within said second combustion zone, said second working fluid stream being independent of said first working fluid stream, an amount of fuel and air supplied to the second combustion zone being adjusted to control the second combustion zone temperature to a second predetermined value.

2. The method of claim 1 wherein said first and second zones are in a single furnace.

3. The method of claim 1 wherein said first stream of air is preheated using heat from said second flue gas stream.

4. The method of claim 3 wherein said second stream of air is preheated using heat from said second flue gas stream.

5. The method of claim 2 wherein said first heat exchanger conduits surround said first combustion zone, and said second heat exchanger conduits surround said second combustion zone.

6. The method of claim 1 further comprising passing said second flue gas through a first convective zone and transferring heat from said first convective zone to a third working fluid stream from an externally fired power system in third heat exchanger conduits exposed to said first convective zone.

7. The method of claim 6 further comprising passing said second flue gas from said first convective zone through a second convective zone and transferring heat from said second convective zone to a fourth working fluid stream from an externally fired power system in fourth heat exchanger conduits exposed to said second convective zone.

8. The method of claim 6 wherein said third working fluid stream is connected in series with one of said first and second working fluid streams.

9. The method of claim 7 wherein said third working fluid stream is connected in series with one of said first and second working fluid streams, and said fourth working fluid stream is connected in series with the other of said first and second working fluid streams.

10. The method of claim 7 wherein said first and second streams of air are preheated using heat from said second flue gas stream received from said second convective zone.

11. The method of claim 1 further comprising providing one or more further combustion zones connected in series to receive the second flue gas stream, further respective streams of air, and further respective portions of the total amount of combustion fuel, combusting said further respective portions of the total amount of fuel in said further combustion zones to form further respective flue gas streams, and transferring heat from said further combustion zones to respective further working fluid streams from an externally fired power system in further heat exchanger conduits exposed to said further combustion zones, the amounts of fuel and air supplied to the further combustion zones being adjusted to control the temperatures of the further combustion zones to respective predetermined values.

12. Apparatus for supplying heat to an externally fired power system comprising:

a first combustion zone connected to receive a first stream of air and a first portion of a total amount of combustion fuel and providing a first flue gas stream including products of combusting said first portion of fuel in said first combustion zone, first heat exchanger conduits located within said first combustion zone and conveying a first working fluid stream from said externally fired power system, control mechanisms for controlling an amount of fuel and air supplied to said first combustion zone to control the first combustion zone temperature to a first predetermined value, a second combustion zone connected to receive said first flue gas stream, a second stream of air, and a second portion of the total amount of combustion fuel and providing a second flue gas stream including the products of combusting said second portion of fuel in said second combustion zone, second heat exchanger conduits located within said second combustion zone and conveying a second working fluid stream from said externally fired power system, said second working fluid stream being independent of said first working fluid stream, and control mechanisms for controlling an amount of fuel and air supplied to said second combustion zone to control the second combustion zone temperature to a second predetermined value.

13. The apparatus of claim 12 wherein said first and second zones are in a single furnace.

14. The apparatus of claim 12 further comprising a preheater for preheating said first stream of air using heat from said second flue gas stream.

15. The apparatus of claim 14 wherein said preheater preheats said second stream of air using heat from said second flue gas stream.

16. The apparatus of claim 13 wherein said first heat exchanger conduits surround said first combustion zone, and said second heat exchanger conduits surround said second combustion zone.

17. The apparatus of claim 12 further comprising a first convective zone connected to receive said second flue gas stream from said second combustion zone, and third heat exchanger conduits exposed to said first convective zone and conveying a third working fluid stream from an externally fired power system.

18. The apparatus of claim 17 further comprising a second convective zone connected to receive said second flue gas stream from said first convective zone, and fourth heat exchanger conduits exposed to said second convective zone and conveying a fourth working fluid stream from an externally fired power system.

19. The apparatus of claim 17 wherein said third working fluid stream is connected in series with one of said first and second working fluid streams.

20. The apparatus of claim 18 wherein said third working fluid stream is connected in series with one of said first and second working fluid streams, and said fourth working fluid stream is connected in series with the other of said first and second working fluid streams.

21. The apparatus of claim 18 further comprising a preheater for preheating said first and second streams of air using heat from said second flue gas stream received from said second convective zone.

22. The apparatus of claim 12 further comprising one or more further combustion zones connected in series to receive the second flue gas stream, further respective streams of air, and further respective portions of the total amount of combustion fuel, further heat exchanger conduits exposed to respective said further combustion zones and conveying further respective working fluid streams from an externally fired power system, and further control mechanisms for controlling the amounts of fuel and air supplied to said further combustion zones to control the temperatures of the further combustion zones to further predetermined values.

* * * * *